US005715683A

United States Patent [19]

Hofbauer et al.

[11] Patent Number: 5,715,683

[45] Date of Patent: Feb. 10, 1998

[54] HEATING AND COOLING MACHINE

[75] Inventors: Peter Hofbauer, Rosrath; Klaus Heikrodt, Krefeld, both of Germany

[73] Assignees: Robert Bosch GmbH, Stuttgart; Viessmann Werke GmbH & Co., Allendorf am Eder, both of Germany

[21] Appl. No.: 436,261

[22] PCT Filed: Aug. 19, 1994

[86] PCT No.: PCT/EP94/02754

§ 371 Date: Jan. 16, 1996

§ 102(e) Date: Jan. 16, 1996

[87] PCT Pub. No.: WO95/06848

PCT Pub. Date: Mar. 9, 1995

[30] Foreign Application Priority Data

Aug. 28, 1993 [DE] Germany ..... 43 28 992.4

[51] Int. Cl.[6] ..... F25B 9/00

[52] U.S. Cl. ..... 62/6; 60/517; 60/520

[58] Field of Search ..... 62/6; 60/517, 520

[56] References Cited

U.S. PATENT DOCUMENTS

| | | | |
|---|---|---|---|
| 153,440 | 7/1874 | Laubereau | 60/517 |
| 639,999 | 12/1899 | Kennedy | 60/517 |
| 2,599,611 | 6/1952 | Clay . | |
| 4,052,854 | 10/1977 | du Pre et al. . | |
| 4,352,269 | 10/1982 | Dineen . | |
| 4,354,352 | 10/1982 | Hoke et al. | 60/517 |
| 4,387,568 | 6/1983 | Dineen | 60/517 X |
| 4,821,516 | 4/1989 | Isshiki | 60/517 |
| 4,967,558 | 11/1990 | Emigh et al. | 60/520 |
| 5,005,349 | 4/1991 | Momose et al. . | |
| 5,214,923 | 6/1993 | Kown . | |
| 5,433,078 | 7/1995 | Shin | 60/517 |

FOREIGN PATENT DOCUMENTS

| | | |
|---|---|---|
| 4206957 | 9/1993 | Germany . |
| 5825556 | 2/1983 | Japan . |
| 62168956 | 7/1987 | Japan . |

OTHER PUBLICATIONS

Hans–Detlev Kühl et al; Der Vuilleumier–Prozess als Wärmepumpe; 1986.

*Primary Examiner*—Christopher Kilner
*Attorney, Agent, or Firm*—Robert W. Becker & Associates

[57] ABSTRACT

A heating and cooling machine, operating according to a regenerative gas cycle process with a working medium, has a pressure-tight housing and a heat source connected inside the housing. Two linearly moveable pistons are positioned inside the housing. The two pistons delimit therebetween a warm working volume and are driveable by a control unit. The first piston together with the housing delimits a hot working volume loaded with heat from the heat source. The second piston together with the housing delimits a cold working volume. Regenerators as well as a warm heat transfer element and a cold heat transfer element are positioned in the housing. The three working volumes communicate with one another through the regenerators and the warm and cold heat transfer elements. A partition for transmitting heat energy generated by the heat source to the hot working volume, has the shape of a radially symmetrical dome and is connected to the housing so as to be heat-insulated relative to the housing.

16 Claims, 2 Drawing Sheets

HEATING AND COOLING MACHINE

BACKGROUND OF THE INVENTION

The invention relates to a heating and cooling machine operating according to a regenerative gas cycle process and having two pistons linearly moveable within a pressure-tight housing which together delimit a warm working volume and whereby one of the pistons delimits in the housing a hot working volume subjected to heat and the other piston delimits a cold working volume, whereby the three working volumes are connected to one another by interposing regenerators and heat transfer elements and whereby a drive and/or a control for the pistons is provided.

Such heating and cooling machines, which, for example, operate according to the Stirling or Vuilleumier cycle process, have been known for a long time, for example, from British Patent 136 195. However, despite the undeniable advantages of the regenerative gas cycle process these machines have not found acceptance in practice, mainly due to constructive problems, which prevent the realization of the theoretical advantages of such machines in practice. Even recent publications, for example, European patent application 0 238 707 A2, deal more with theoretical considerations than with practical embodiments of such heating and cooling machines.

In order to realize an industrial manufacture of such heating and cooling machines past the stage of a prototype for general daily use of such heating and cooling machines, it is necessary to optimize the individual components of these machines. It is an object of the invention to further develop a heating and cooling machine of the afore defined kind such that a good introduction of heat energy into the hot working volume results while providing small exterior dimensions and high pressure of the required components which furthermore should have a minimal wall thickness by improving the heat transfer.

SUMMARY OF THE INVENTION

The solution to this object according to the invention is characterized in that the heat energy is guided into the hot working volume via an inwardly or outwardly curved (relative to the interior of the housing) partition that forms at the same time a part of the pressure-tight housing, the partition being in the form of a radially symmetrical dome, having a cross-section along its central axis in the form of a conic section especially a semi-sphere and connected with the housing in a heat-insulating manner.

The heating and cooling machine, operating according to the principle of a regenerative gas cycle process with a working medium, according to the present invention is primarily characterized by:

a pressure-tight housing;

a heat source connected in the housing;

two linearly moveable pistons positioned inside the housing, the two pistons delimiting therebetween a warm working volume and driveable by a control unit;

wherein a first one of the pistons together with the housing delimits a hot working volume loaded with heat energy from the heat source;

wherein a second one of the pistons together with the housing delimits a cold working volume;

regenerators positioned in the housing;

a warm heat transfer element and a cold heat transfer element positioned in the housing;

wherein the hot working volume, the warm working volume, and the cold working volume communicate with one another through the regenerators and the warm and cold heat transfer elements; and a partition having the shape of a radially symmetrical dome for transmitting heat generated by the heat source to the hot working volume, the partition connected to the housing so as to be heat-insulated relative to the housing.

Preferably, the partition has a cross-section along a central axis in the form of a conic section. Expediently, the partition is shaped as a semisphere.

In a preferred embodiment, the partition is curved inwardly relative to the hot working volume.

In another preferred embodiment, the partition is curved outwardly relative to the hot working volume.

Expediently, the partition has a surface facing the working volume and comprising surface area-enlarging ribs.

In another embodiment, the partition has a surface facing away from the working volume and comprising surface area-enlarging ribs.

The partition has a surface facing away from the working volume and comprising surface area-enlarging ribs.

Preferably, the partition has a surface facing away from the working volume. The surface has a rim portion provided with flow channels increasing the flow velocity of the flue gas. The flow channels are advantageously formed by rib members or baffle plates.

Expediently, the heat source generates heat energy with a high proportion of heat radiation. The heat source is preferably a gas burner comprising a burner surface having a shape matching the shape of the partition.

The first piston has a piston bottom with a shape matching the shape of the partition.

The partition has a surface facing the working volume and the surface has a rim portion provided with flow channels increasing the flow velocity of the working medium.

The flow channels are formed by rib members or baffle plates.

Due to the inwardly or outwardly curved partition, which is at the same time a part of the pressure-tight housing, on the one hand a large surface area results for a given exterior dimension while high pressure-tightness of the heat-transferring surface is provided and, on the other hand, the possibility exists to select a reduced wall thickness in order to increase the heat introduction. Due to the heat insulation of the curved partition relative to the housing a heat dissipation from the partition into the housing and thus into the which would otherwise reduce the efficiency, is prevented.

According to another feature of the invention the partition can be provided at its exterior and/or interior side with surface area-increasing ribs. Furthermore, it is inventively possible to provide the rim portion of the exterior side of the partition with flow channels, for example, in the form of ribs or baffle plates that increase the flow velocity of the heat-transfer medium.

In a preferred embodiment of the invention the heat energy to be introduced by a heat source is generated so as to have a high radiation component so that the dimensions of the inventive heating and cooling device can be reduced. The heat source can inventively be a gas burner, especially one provided with a glowing surface that matches the shape of the partition.

In order to minimize dead space for the heat transfer between the hot piston and the partition and to improve the heat transfer from the partition into the working gas within the hot working volume, the hot piston is inventively provided with a piston bottom having a shape that matches the shape of the curved partition whereby due to the curvature of the piston bottom its wall thickness can be reduced for achieving a same stiffness so that the weight of the hot piston can be reduced also.

It is furthermore suggested with the invention to provide the interior side of the partition at its rim portion with flow channels, for example, in the form of ribs or baffle plates, that increase the flow velocity in order to improve thereby the heat transfer from the partition to the working gas within the hot working volume.

Due to the inventive embodiment of a heating and cooling machine with respect to introduction of the heat energy generated by a heat source into the working medium contained within the hot working volume, a practice-oriented construction is provided which increases, on the one hand, the efficiency of the heating and cooling machine and, on the other hand, allows for an industrial manufacture of such machines.

BRIEF DESCRIPTION OF THE DRAWINGS

In the drawing one embodiment of the inventive heating and cooling machine is represented and it is shown in.

DESCRIPTION OF PREFERRED EMBODIMENTS

Figure 1:
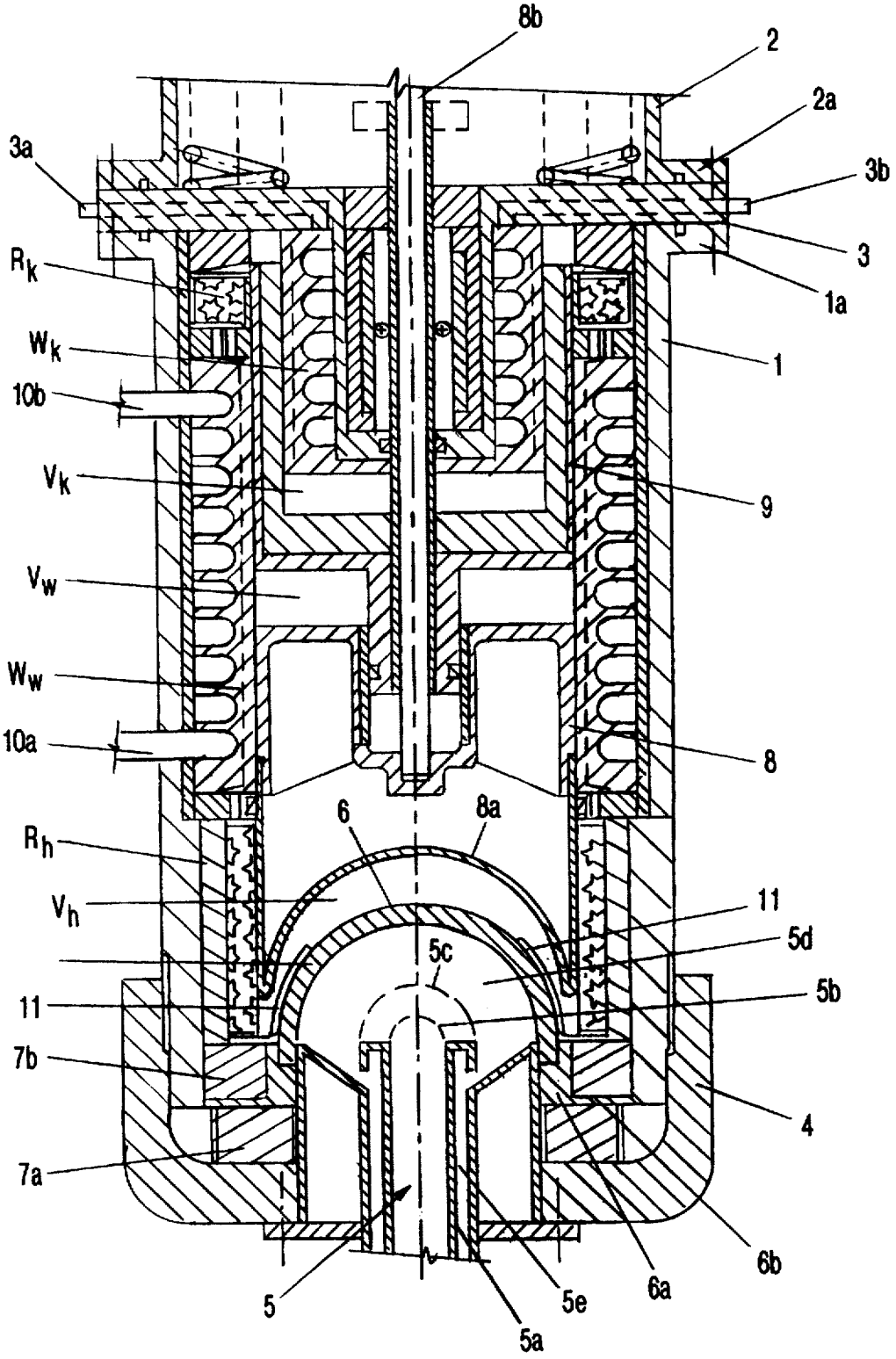
FIG. 1 a longitudinal section of the part of the machine comprising the pressure-tight housing in which the two pistons are positioned and FIG. 2 an enlarged cross-sectional view of a further embodiment of the partition.

The machine represented in longitudinal section in FIG. 1 comprises a pressure-tight housing 1 in the form of a circular cylinder which is provided at one end with a flange 1*a* to which is screwed the motor housing 2 with a corresponding flange 2*a*. The motor housing 2 is only partially represented. Between the flanges 1*a* and 2*a* a pressure-tight bottom 3 is arranged which closes off one end of the housing 1.

At the other end the pressure-tight housing 1 is provided with a housing cover 4 that, in the shown embodiment, is screwed with a thread to the cylindrical housing 1 and in which a heat source in the form of a gas burner 5 is arranged. This gas burner comprises a cylindrical inlet pipe 5*a* for the fuel gas which having at its exit a semi-spherical dosage means 5*b*.

Concentric to this semi-spherical dosage means 5*b* a burner surface 5*c*, acting as a reaction surface and made of a stainless steel mesh, is arranged which delimits the gas inflow chamber and glows during operation of the gas burner so that the gas burner 5 releases a great portion of the generated heat energy by radiation. The produced flue gases are removed from the combustion chamber 5*d*, surrounding the semi-spherical burner surface 5*c*, via an exhaust gas pipe 5*e* which concentrically surrounds the inlet pipe 5*a* of the gas burner 5.

The heat energy generated by the gas burner 5 is released by radiation and convection to the partition 6 which is in the form of a radially-symmetrical conic section, in the embodiment a semi-sphere, and is curved into the interior of the housing 1. In the embodiment the semi-spherical curvature extends at a uniform distance to the semi-spherical burner surface 5*c* of the gas burner 5.

The partition 6, which is embodied as part of the pressure-tight housing 1, is connected to a support ring 6*a* which is connected via a diaphragm-type extension 6*b* to the end of the cylindrical housing 1. In the embodiment both connections are realized by welding. By using insulating rings 7*a* and 7*b* which are arranged respectively on one side of the diaphragm-like extension 6*b*, on the one hand facing the housing cover 4 and, on the other hand, facing the housing 1, the heat dissipation from the partition 6, heated by the gas burner 5, into the housing 1 and into its housing cover 4 and thus into the environment is considerably reduced.

The heat energy generated by the gas burner 5 and received by the partition is transferred by the interior side of the partition 6 to a working medium, preferably helium, which is contained within the hot working volume $V_h$. This hot working volume is delimited, on the one hand, by the partition 6 and, on the other hand, by the piston bottom 8*a* of the piston 8 which is arranged as to be linearly moveable within the housing 1. This piston 8 is connected via a piston rod 8*b* with a motor, respectively, a control arranged within the motor housing 2 which control or motor are not represented in the drawing.

The piston 8 delimits together with a further piston 9 a warm working gas medium $V_w$. The piston 9 which is also guided within the housing 1 so as to be linearly moveable, delimits with its interior a cold working volume $V_k$. These three volumes are connected to one another by interposing regenerators $R_h$, $R_k$ and heat transfer elements $W_w$, $W_k$. The regenerator $R_h$ arranged within the hot part of the housing 1 stores during the course of the regenerative gas cycle process a portion of the heat energy transferred to the hot working volume $V_h$. The regenerator $R_k$ positioned within the cold part of the housing 1 has the corresponding function with respect to the cold working volume $V_k$.

To the heat transfer element $W_k$, in the embodiment stationaraly arranged within the cold piston 9 at the bottom 3, a medium is supplied which is continuously drawn in from the environment via line 3*a* which medium, after removal of a portion of its heat energy, is returned via line 3*b* into the environment. The heat exchanger $W_w$ is supplied via connecting lines 10*a*, 10*b* with a heat transfer medium the heating of which serves for generating energy when the machine is used as a heating machine.

Due to the curvature of the partition 6 into the interior of the pressure-tight housing 1 there results not only an increased pressure resistance due to its geometric shape which allows for a reduction of the wall thickness of the partition is part of the pressure-tight housing 1, but also results in an increase of the heat-transfer surface area between the gas burner 5 and the hot working volume $V_h$. The reduced wall thickness of the partition 6 improves furthermore the heat transfer from the gas burner 5 onto the working medium within the hot working volume $V_h$. The heat insulation, which in the embodiment is formed by the insulating rings 7*a*, 7*b* as well as the membrane-shaped extension 6*b*, positioned between the partition 6 and the housing 1, reduces simultaneously the heat dissipation from the partition 6 into the housing 1 and thus into the environment so that the efficiency is further increased.

As can be taken from FIG. 1, the shape of the piston bottom 8*a* of the hot piston 8 matches the shape of the curved partition 6. This not only reduces the dead space between the partition 6 and the hot piston 8 to a minimum, when the hot piston 8 is positioned in a position adjacent to the partition 6, but also achieves a higher flow velocity and thus an increased heat transfer due the adaptation of the shape, when during the course of the cycle process the working medium flows from the decreasing hot working volume $V_h$ via the regenerator $R_h$ and the heat transfer element $W_w$ into the space for the warm working volume $V_w$ that is formed between the two pistons 8 and 9.

Since due to the curvature of the piston bottom 8*a* adapted to the partition 6 and the resulting greater form stability the wall thickness of the piston bottom 8*a* can be reduced, losses due to heat dissipation from the hot working volume $V_h$ via the hot piston 8 are also reduced.

In order to increase the surface area of the partition 6 which serves, on the one hand, for receiving heat energy and, on the other hand, for releasing heat energy, the partition may be provided at its exterior and/or interior side with surface area-increasing ribs. The embodiment of FIG. 1 shows an alternative or additional possibility for improving the heat transfer from the interior wall of the partition 6 into the hot working medium contained within the hot working volume $V_h$ in form of a baffle plate 11 arranged at the rim portion of the partition 6. This baffle plate 11 forms at the rim portion of the partition 6 flow channels of a small flow cross-section so that the working medium leaving the hot working volume $V_h$ is guided at a high flow velocity along the rim portion of the partition 6 before entering the regenerator $R_h$. With this measure a further efficiency improvement is achieved.

Figure 2:
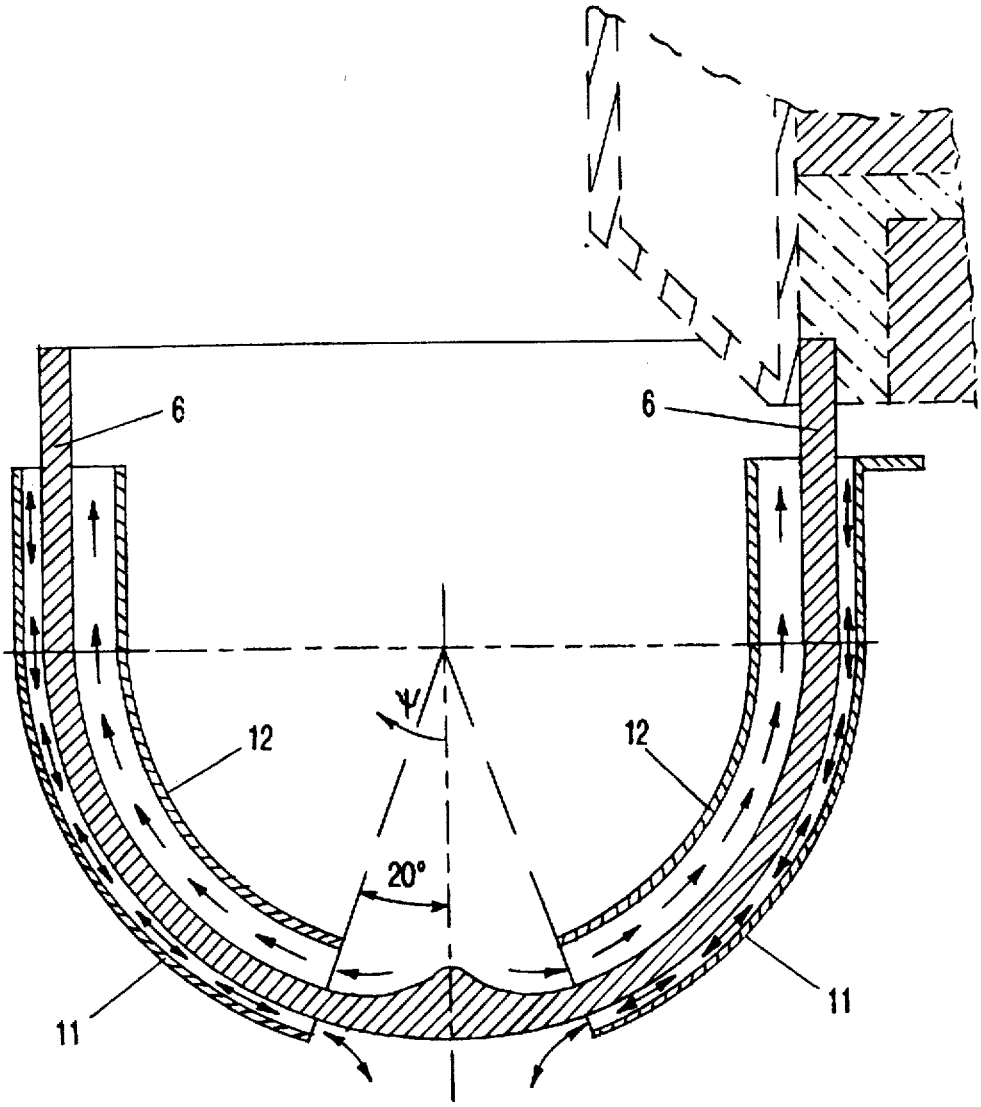

The arrangement of such a baffle plate 11 is also shown in the enlarged representation of a partition 6 according to a second embodiment shown in FIG. 2. This alternative embodiment shows that the exterior side of the curved partition 6 has arranged thereat a baffle plate 12 through which the flue gases leaving the combustion chamber 5*d* are forced so as to flow at an increased flow velocity over the greater portion of the exterior surface of the partition 6 so that a good transfer of heat energy from the heat-releasing flue gas into the heat-receiving partition 6 results. The present invention is, of course, in no way restricted to the specific disclosure of the specification and drawings, but also encompasses any modification within the scope of the appended claims.

What we claim is:

1. A heating and cooling machine operating according to the principle of a regenerative gas cycle process with a working medium, said machine comprising:

a pressure-tight housing;

a heat source connected in said housing;

two linearly moveable pistons positioned inside said housing, said two pistons delimiting therebetween a warm working volume and driveable by a control unit;

wherein a first one of said pistons together with said housing delimits a hot working volume loaded with heat energy from said heat source;

wherein a second one of said pistons together with said housing delimits a cold working volume;

regenerators positioned in said housing;

a warm heat transfer element and a cold heat transfer element positioned in said housing;

wherein said hot working volume, said warm working volume, and said cold working volume communicate with one another through said regenerators and said warm and cold heat transfer elements; and a partition having the shape of a radially symmetrical dome for transmitting heat generated by said heat source to said hot working volume, said partition connected to said housing so as to be heat-insulated relative to said housing.

2. A machine according to claim 1, wherein said partition has a cross-section along a central axis in the form of a conic section.

3. A machine according to claim 1, wherein said partition is a semi-sphere.

4. A machine according to claim 1, wherein said partition is curved inwardly relative to said hot working volume.

5. A machine according to claim 1, wherein said partition has a surface facing said working volume and comprising surface area-enlarging ribs.

6. A machine according to claim 5, wherein said partition has a surface facing away from said working volume and comprising surface area-enlarging ribs.

7. A machine according to claim 1, wherein said partition has a surface facing away from said working volume and comprising surface area-enlarging ribs.

8. A machine according to claim 1, wherein said partition has a surface facing away from said working volume and wherein said surface has a rim portion provided with flow channels increasing the flow velocity of the flue gas.

9. A machine according to claim 8, wherein said flow channels are formed by rib members.

10. A machine according to claim 8, wherein said flow channels are formed by baffle plates.

11. A machine according to claim 1, wherein said heat source generates heat energy with a high proportion of heat radiation.

12. A machine according to claim 11, wherein said heat source is a gas burner comprising a burner surface having a shape matching said shape of said partition.

13. A machine according to claim 1, wherein said first piston has a piston bottom having a shape matching said shape of said partition.

14. A machine according to claim 13, wherein said partition has a surface facing said working volume and wherein said surface has a rim portion provided with flow channels increasing the flow velocity of the working medium.

15. A machine according to claim 14, wherein said flow channels are formed by rib members.

16. A machine according to claim 14, wherein said flow channels are formed by baffle plates.

* * * * *